US007178192B2

(12) United States Patent
Huang

(10) Patent No.: US 7,178,192 B2
(45) Date of Patent: Feb. 20, 2007

(54) BATH BRUSH

(75) Inventor: Min-Tsung Huang, Taichung (TW)

(73) Assignee: Shih-Ming Huang, Keelung (TW)

( * ) Notice: Subject to any disclaimer, the term of this patent is extended or adjusted under 35 U.S.C. 154(b) by 637 days.

(21) Appl. No.: 10/638,932

(22) Filed: Aug. 8, 2003

(65) Prior Publication Data

US 2005/0028310 A1 Feb. 10, 2005

(51) Int. Cl.
*A47K 7/02* (2006.01)

(52) U.S. Cl. ..... 15/209.1; 15/229.13; 15/229.11; 15/210.1

(58) Field of Classification Search ..... 15/229.11, 15/229.12, 229.13, 229.14, 222, 110, 209.1, 15/210.1, 176.1, 176.5, 176.6; 300/21; 601/135, 601/137, 138
See application file for complete search history.

(56) References Cited

U.S. PATENT DOCUMENTS 6,092,258 A * 7/2000 Chen ..... 15/209.1
6,276,022 B1 * 8/2001 Gallacher ..... 15/209.1
6,370,723 B1 * 4/2002 Chang ..... 15/110
6,453,503 B1 * 9/2002 Chen ..... 15/209.1
6,510,577 B1 * 1/2003 Borcherds et al. ..... 15/118
6,931,689 B2 * 8/2005 Huang ..... 15/209.1
2002/0166189 A1 * 11/2002 Huang ..... 15/209.1
2003/0051304 A1 * 3/2003 Chang ..... 15/209.1

* cited by examiner

*Primary Examiner*—Gary K. Graham
(74) *Attorney, Agent, or Firm*—Alan D. Kamrath; Nikolai & Mersereau, P.A.

(57) ABSTRACT

A bath brush has a holding frame, a thread girdle, and a tube-shaped elastic net. The holding frame has a corrugated handle portion having an end hole, and a binding portion having a plurality of protruded blocks. Each protruded block has a through aperture. The protruded blocks contact the tube-shaped elastic net. The thread girdle surrounds the tube-shaped elastic net to squeeze and to bind the tube-shaped elastic net. The thread girdle is inserted through the protruded blocks to form a plurality of X-shaped twin lines.

7 Claims, 7 Drawing Sheets

BATH BRUSH

BACKGROUND OF THE INVENTION

The present invention relates to a bath brush. More particularly, the present invention relates to a bath brush which is easily assembled.

U.S. Pat. No. 6,092,258 has disclosed a bath brush including an elastic mesh tube, a grip member and a binding member. The elastic mesh tube is axially squeezed and compressed. The grip member is disposed on an outer side of the elastic mesh tube and formed with a first fixing portion and a second fixing portion spaced from each other, and at least a third fixing portion between the first fixing portion and the second fixing portion. The binding member has a predetermined length. The binding member is formed with a first binding section and a second binding section spaced from each other, a pressing section between the first binding section and the second binding section, and at least a third binding section disposed on the pressing section. The first binding section serves to fix a part of one end of the elastic mesh tube on the first fixing portion and the second binding section serves to fix a part of the other end of the elastic mesh tube on the second fixing portion, while the pressing section serves to press a middle of the elastic mesh tube against a section of the grip member between the first fixing portion and the second fixing portion, The third binding section serves to fix the pressing section on the corresponding third fixing portion. The elastic mesh tube is compressed by the binding member into an elongated shape and fixed on the grip member. However, the pressing section presses the middle portion of the elastic mesh tube with a single line only. The elastic mesh tube will slide away from the binding member while a user uses the bath brush. Furthermore, the bath brush cannot massage a human body.

SUMMARY OF THE INVENTION

An object of the present invention is to provide a bath brush which is easily assembled.

Another object of the present invention is to provide a bath brush which has a thread girdle to form a plurality of twin lines to compress a tube-shaped elastic net stably so that the tube-shaped elastic net will not slide away from a holding frame.

Another object of the present invention is to provide a bath brush which has an arc-shaped holding frame to be held comfortably according to a human engineering.

Another object of the present invention is to provide a bath brush which has a holding frame having a plurality of semispheric protruded blocks to massage a human body.

Accordingly, a bath brush comprises a holding frame, a thread girdle, and a tube-shaped elastic net. The holding frame has a corrugated handle portion having an end hole, and a binding portion having a plurality of protruded blocks. Each of the protruded blocks has a through aperture. The protruded blocks contact the tube-shaped elastic net. The thread girdle surrounds the tube-shaped elastic net to squeeze and to bind the tube-shaped elastic net. The thread girdle is inserted through the protruded blocks to form a plurality of X-shaped twin lines.

DETAILED DESCRIPTION OF THE INVENTION

Figure 1:
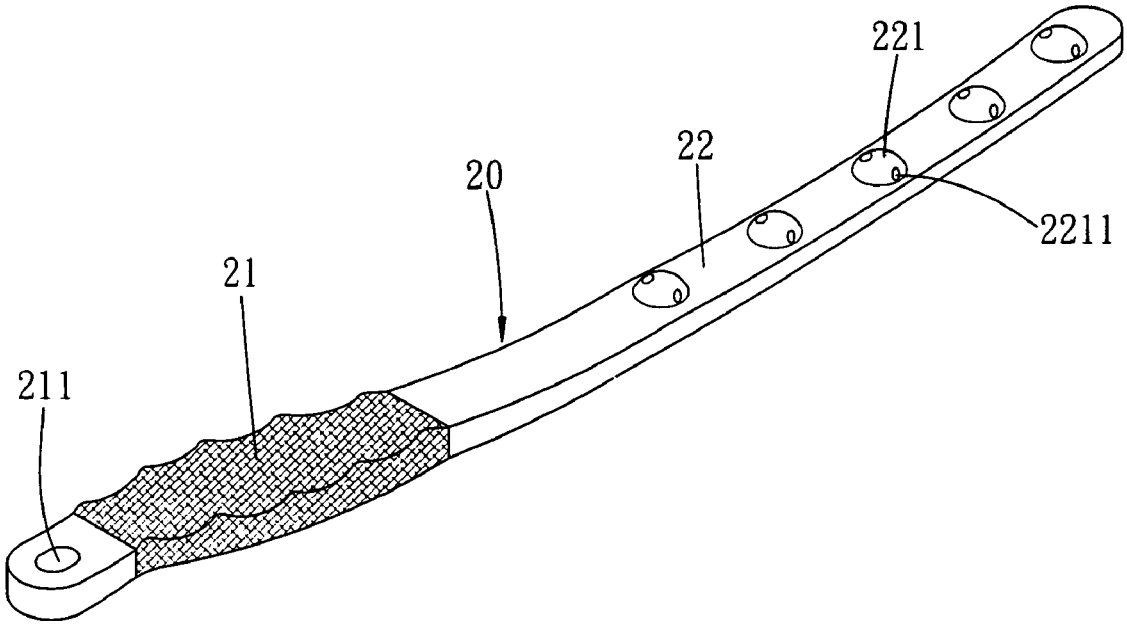
FIG. 1 is a perspective view of a holding frame of a first preferred embodiment in accordance with the present invention.
Figure 2A:
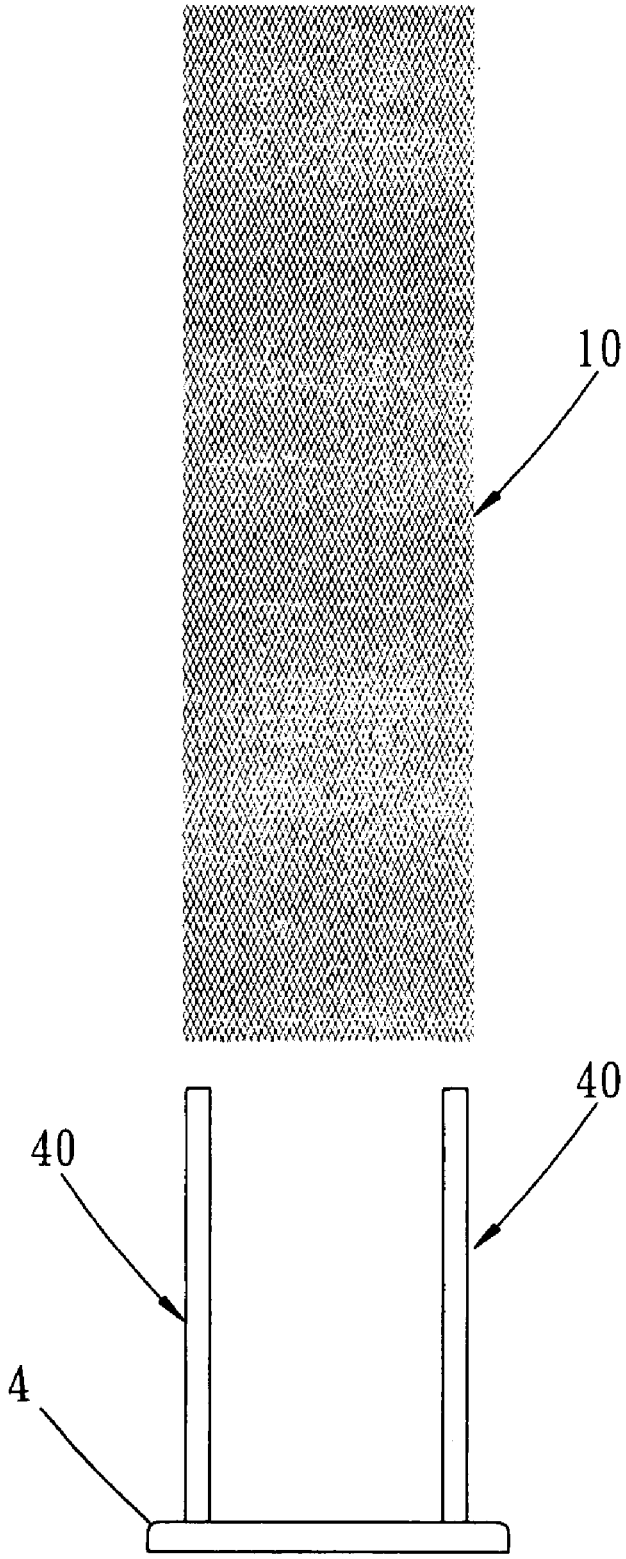
FIG. 2*a* is a perspective schematic view illustrating a tube-shaped elastic net and two posts of a plate of a first preferred embodiment in accordance with the present invention.
Figure 2B:
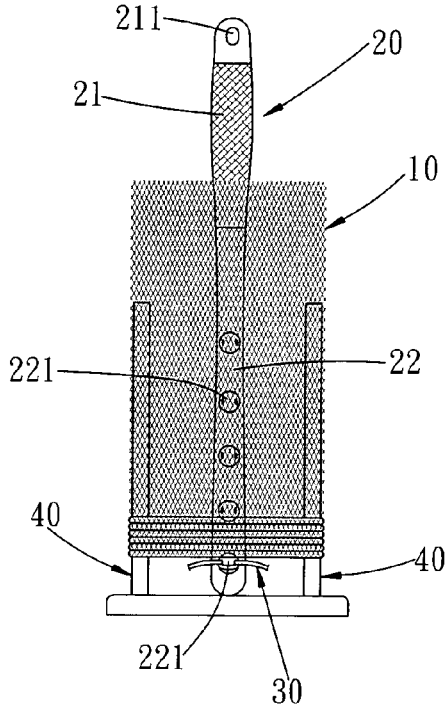
FIG. 2*b* is a perspective schematic view illustrating a first step of making a bath brush of a first preferred embodiment in accordance with the present invention.
Figure 2C:
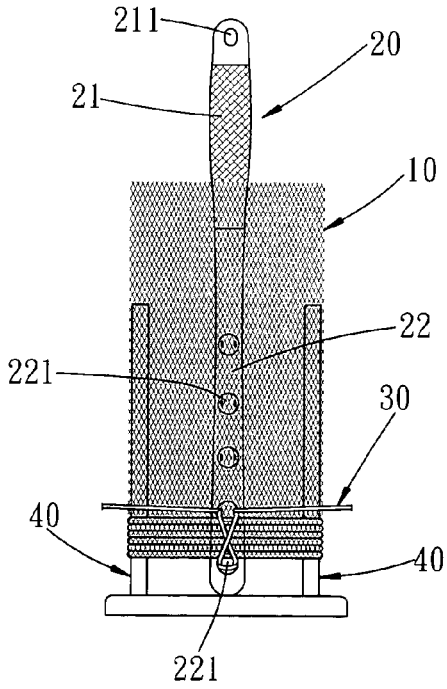
FIG. 2*c* is a perspective schematic view illustrating a second step of making a bath brush of a first preferred embodiment in accordance with the present invention.
Figure 2D:
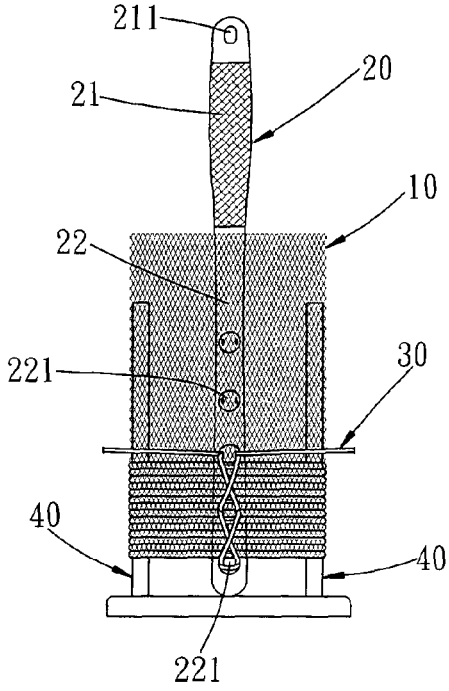
FIG. 2*d* is a perspective schematic view illustrating a third step of making a bath brush of a first preferred embodiment in accordance with the present invention.
Figure 2E:
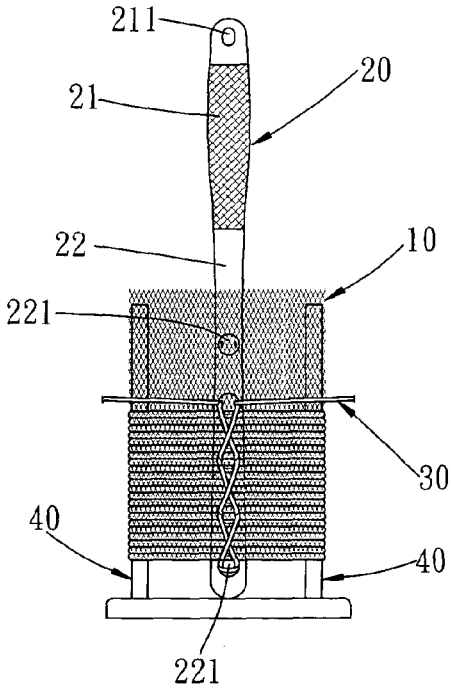
FIG. 2*e* is a perspective schematic view illustrating a fourth step of making a bath brush of a first preferred embodiment in accordance with the present invention.
Figure 2F:
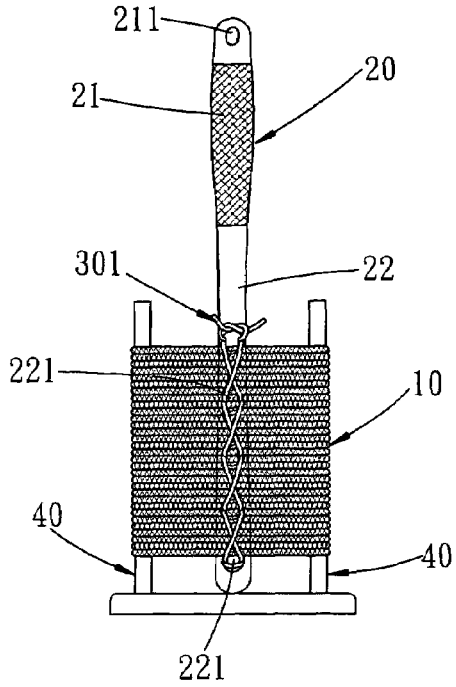
FIG. 2*f* is a perspective schematic view illustrating a fifth step of making a bath brush of a first preferred embodiment in accordance with the present invention.
Figure 3:
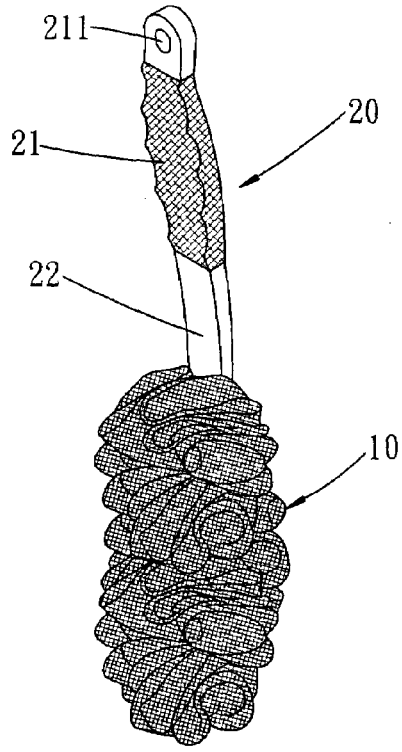
FIG. 3 is a perspective assembly view of a bath brush of a first preferred embodiment in accordance with the present invention.
Figure 4:
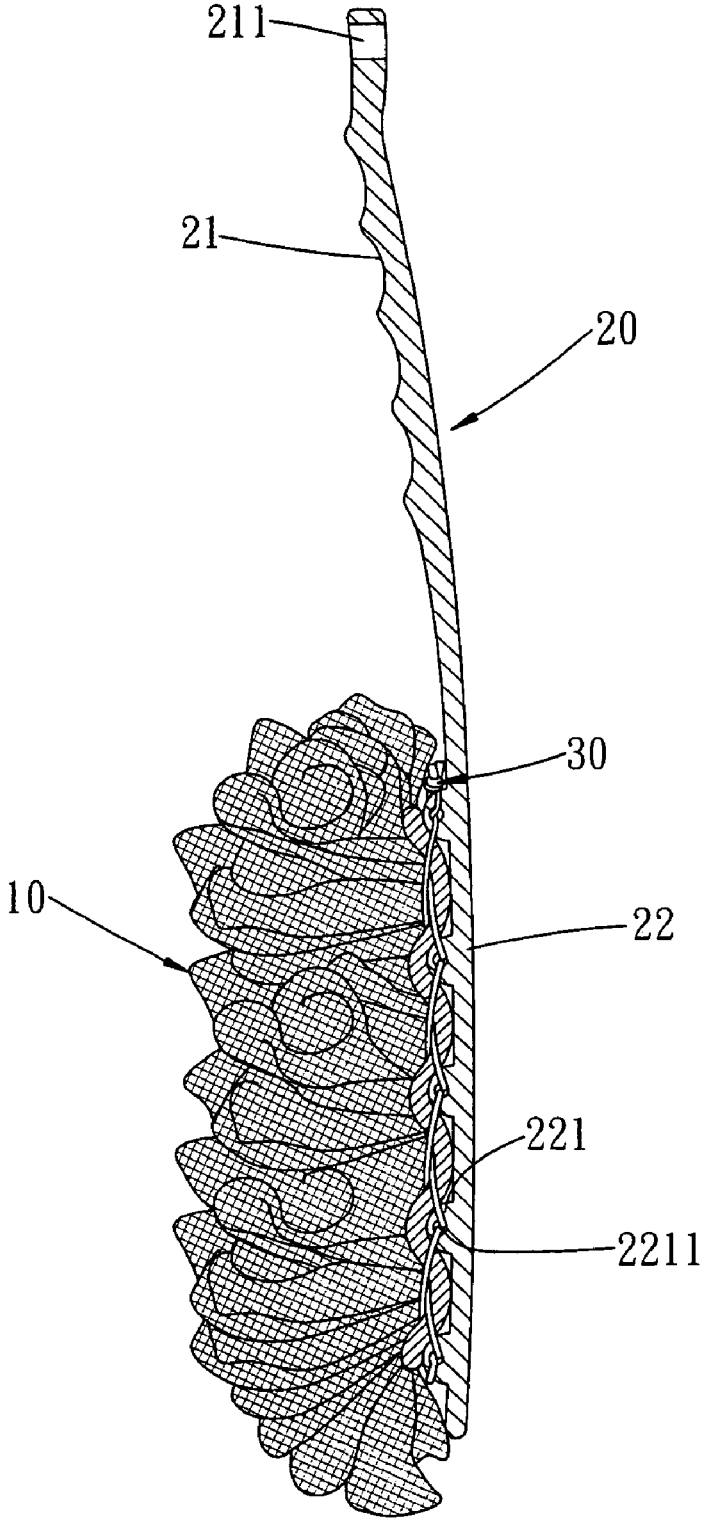
FIG. 4 is a sectional assembly view of a bath brush of a first preferred embodiment in accordance with the present invention.

Referring to FIGS. 1 to 4, a first bath brush comprises a holding frame 20, a thread girdle 30, and a tube-shaped elastic net 10.

The tube-shaped elastic net 10 has a number of meshes. The tube-shaped elastic net 10 has a predetermined length.

The tube-shaped elastic net 10 is made of a plastics material.

The holding frame 20 has a corrugated handle portion 21 having an end hole 211, and a binding portion 22 having five semispheric protruded blocks 221.

Each of the semispheric protruded blocks 221 has a through aperture 2211.

The holding frame 20 is in an arc shape.

Referring to FIGS. 2*a* to 2*f* again, two posts 40 which are disposed on a plate 4 are inserted in the tube-shaped elastic net 10 axially until the tube-shaped elastic net 10 surrounds the posts 40.

The semispheric protruded blocks 221 contact the tube-shaped elastic net 10 axially.

The thread girdle 30 surrounds the tube-shaped elastic net 10 to squeeze and to bind the tube-shaped elastic net 10.

The thread girdle 30 is inserted through the semi-spheric protruded blocks 221 to form a plurality of X-shaped twin lines.

The tube-shaped elastic net 10 is pressed downward.

Two ends of the thread girdle 30 are bound to form a connecting knot 301.

The tube-shaped elastic net 10 is detached from the posts 40 to form a product.

Referring to FIGS. 3 and 4 again, the first bath brush is assembled.

The present invention has the following advantages. The X-shaped twin lines of the thread girdle 30 will compress the tube-shaped elastic net 10 stably so that the tube-shaped elastic net 10 will not slide away from the holding frame 20 while a user uses the bath brush. The present invention provides the arc-shaped holding frame 20 to be held comfortably according to a human engineering. The holding frame 20 has a plurality of semispheric protruded blocks 221 to massage a human body.

Figure 5A:
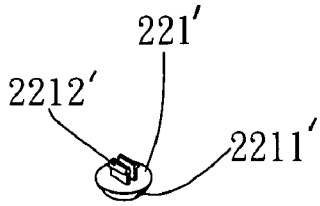
FIG. 5*a* is a perspective view of a semispheric protruded block of a second preferred embodiment in accordance with the present invention.
Figure 5:
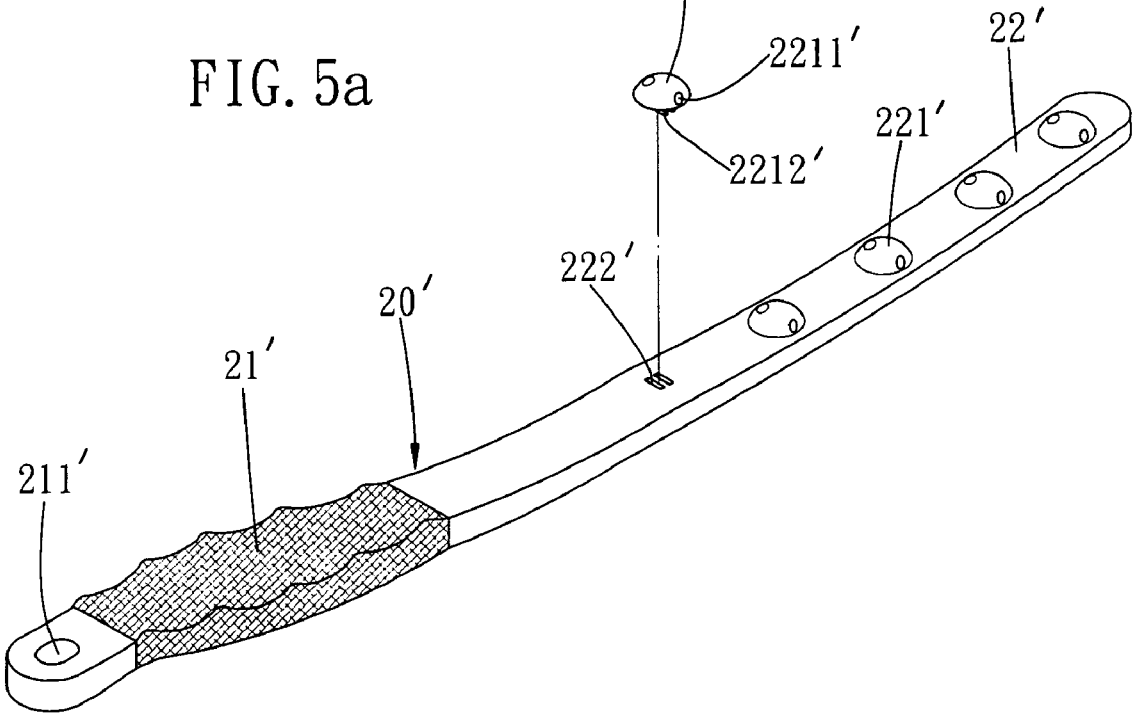
FIG. 5 is a perspective view of a holding frame of a second preferred embodiment in accordance with the present invention.

Referring to FIGS. 5 and 5*a*, a second holding frame 20' comprises a handle portion 21' having an end hole 211', a binding portion 22' having a plurality of oblong apertures, and a plurality of semispheric protruded blocks 221'.

Each of the semispheric protruded blocks 221' has a through aperture 2211' and two click pins 2212'.

Each of the click pins 2212' is inserted in the corresponding oblong aperture 222' of the binding portion 22' of the holding frame 20'.

The present invention is not limited to the above embodiments but various changes in form and detail may be made without departing from the scope of the present invention.

I claim:

1. A bath brush comprises:

a holding frame, a thread girdle, and a tube-shaped elastic net, the holding frame having a corrugated handle portion having an end hole, and a binding portion having a plurality of protruded blocks, each of the protruded blocks having a through aperture, the protruded blocks contacting the tube-shaped elastic net, the thread girdle surrounding the tube-shaped elastic net to squeeze and to bind the tube-shaped elastic net, and the thread girdle inserted through the protruded blocks to form a plurality of X-shaped twin lines.

2. The bath brush as claimed in claim 1, wherein the tube-shaped elastic net has a number of meshes.

3. The bath brush as claimed in claim 1, wherein the tube-shaped elastic net is made of a plastics material.

4. The bath brush as claimed in claim 1, wherein two ends of the thread girdle are bound to form a connecting knot.

5. The bath brush as claimed in claim 1, wherein the holding frame is in an arc shape.

6. The bath brush as claimed in claim 1, wherein each of the protruded blocks is in a semispheric shape.

7. The bath brush as claimed in claim 1, wherein the binding portion of the holding frame has a plurality of oblong apertures, each of the protruded blocks has two click pins, and each of the click pins is inserted in the corresponding oblong aperture of the binding portion of the holding frame.

* * * * *